US007544015B2

(12) United States Patent
Kallen

(10) Patent No.: US 7,544,015 B2
(45) Date of Patent: Jun. 9, 2009

(54) COMPOSITE FORM FOR STABILIZING EARTHEN EMBANKMENTS

(76) Inventor: Michael Charles Kallen, 32805 Richards Avenue, Mission, British Columbia (CA) V2V 7E7

( * ) Notice: Subject to any disclaimer, the term of this patent is extended or adjusted under 35 U.S.C. 154(b) by 348 days.

(21) Appl. No.: 10/566,167

(22) PCT Filed: Jul. 28, 2004

(86) PCT No.: PCT/CA2004/001406

§ 371 (c)(1),
(2), (4) Date: Jan. 27, 2006

(87) PCT Pub. No.: WO2005/012652

PCT Pub. Date: Feb. 10, 2005

(65) Prior Publication Data

US 2006/0204343 A1 Sep. 14, 2006

Related U.S. Application Data

(60) Provisional application No. 60/490,282, filed on Jul. 28, 2003.

(51) Int. Cl.
*E02D 17/20* (2006.01)

(52) U.S. Cl. ..... 405/302.4; 405/262; 405/284; 405/302.6; 405/302.7; 52/589.1; 52/633; 108/92; 108/158.12

(58) Field of Classification Search ..... 405/262, 405/284, 302.4, 302.6, 302.7; 52/589.1; 108/91, 92, 180, 158.12
See application file for complete search history.

(56) References Cited

U.S. PATENT DOCUMENTS

| | | | | |
|---|---|---|---|---|
| 4,117,686 | A | 10/1978 | Hilfiker | |
| 4,345,856 | A | 8/1982 | Tuck | |
| 4,530,622 | A | 7/1985 | Mercer | |
| 4,856,939 | A | 8/1989 | Hilfiker | |
| 5,156,496 | A * | 10/1992 | Vidal et al. | 405/262 |
| 5,522,682 | A | 6/1996 | Egan | |
| 5,531,547 | A | 7/1996 | Shimada | |
| 5,975,810 | A | 11/1999 | Taylor et al. | |

(Continued)

FOREIGN PATENT DOCUMENTS

GB 2295180 A 5/1996

(Continued)

OTHER PUBLICATIONS

Patent Abstracts of Japan, JP 2002-309582 (Tenryu Ind Co Ltd) published Oct. 23, 2002 and related JPO English language translation by computer.

*Primary Examiner*—David J Bagnell
*Assistant Examiner*—Sean D Andrish
(74) *Attorney, Agent, or Firm*—Lance A. Turlock

(57) ABSTRACT

A composite form for stabilizing an earthen embankment includes a floor section and a face section and is couplable to other like forms. The floor section includes integrally formed anchoring members for securing a geogrid with at least one anchoring rod. Advantageously, the face section of the form may included integrally formed hydroseeding screens. Also disclosed is a structure for stabilizing an earthen embankment, the structure comprising such a support form together with a geogrid anchored to the floor section of the form advantageously by a pair anchoring rods, an end portion of the geogrid being wrapped back and forth around the anchoring rods.

18 Claims, 12 Drawing Sheets

U.S. PATENT DOCUMENTS 6,161,776 A * 12/2000 Byles ..... 239/145
6,345,934 B1 2/2002 Jailloux et al.
6,595,726 B1 7/2003 Egan et al.
6,764,252 B2 7/2004 Banting

FOREIGN PATENT DOCUMENTS

JP 2209522 8/1990
JP 04080432 A2 3/1992
JP 07173845 A2 7/1995
JP 2003-049433 A 2/2003

* cited by examiner

COMPOSITE FORM FOR STABILIZING EARTHEN EMBANKMENTS

CROSS-REFERENCE TO RELATED APPLICATIONS

This application is related to U.S. provisional application No. 60/490,282 filed Jul. 28, 2003, entitled "COMPOSITE FORM FOR STABILIZING EARTHEN EMBANKMENTS", naming Michael Charles Kallen as the inventor. The contents of the provisional application are incorporated herein by reference in their entirety, and the benefit of the filing date of the provisional application is hereby claimed for all purposes that are legally served by such claim for the benefit of the filing date.

FIELD OF THE INVENTION

The present invention relates to support forms and structures for stabilizing earthen embankments.

BACKGROUND OF THE INVENTION

It is well known in the prior art to stabilize an earthen embankment with support forms and associated geogrids extending rearwardly from the support forms into the embankment. In many cases, the support forms are wire cage structures which have a simple geometry but which are not necessarily well adapted for ease of manufacture or ease of use. Further they are not necessarily well adapted to enable one support form to be coupled above and below with other like support forms, and they are not necessarily well adapted to enable a soft geogrid to be easily anchored to the support form in a manner which enables a secure connection with minimal detrimental stress on the geogrid. Moreover, existing designs generally do not contemplate support forms which are designed to facilitate hydroseeding not only at a construction site but also at a remote site prior to installation at a construction site.

SUMMARY OF THE INVENTION

In accordance with the present invention, there is provided a composite form for stabilizing an earthen embankment, the form comprising a floor section, a face section, a first coupling means integral with the form for coupling the form with a like form extending above the form, and a second coupling means integral with the form for coupling the form with a second like form extending below the form.

The floor section extends longitudinally rearwardly from a forward end of the floor section to a rearward end of the floor section, and includes a plurality of horizontally spaced anchoring members formed integrally with the floor section. The anchoring members are located proximate to the rearward end of the floor section and their purpose is to holdingly engage at least one geogrid anchoring rod. The floor section also includes a plurality of drainage openings extending through the floor section to permit the drainage of moisture.

The face section is formed integrally with and extends longitudinally at an angle upwardly from the forward end of the floor section to a top end of said face section. It includes a first plurality of supporting ribs and a second plurality of supporting ribs, the second plurality of supporting ribs intersecting the first plurality of supporting ribs to define a plurality of regions bounded by the ribs. The upward angle of the face section will generally correspond with the slope of the embankment to be stabilized but may be up to substantially 90 degrees.

Preferably, each anchoring member comprises a boss, each boss including a hole extending through the boss, the holes in all bosses being axially aligned. A linearly extending geogrid anchoring rod may then be longitudinally inserted through all of such holes.

In one embodiment of the present invention, the first coupling means comprises a plurality of horizontally spaced hooking members extending upwardly from the face section. The second coupling means comprises a plurality of horizontally spaced slots extending through the floor section, the slots are preferably T-shaped and are sized to receive and couple with cooperating hooking members extending upwardly from the second like form.

In another embodiment of the present invention, the form further comprises a flange extending forwardly from the top end of the face section. The first coupling means comprises a plurality of horizontally spaced hooking members extending forwardly from the forward end of said floor section, and the second coupling means comprises a plurality of horizontally spaced slots extending through the flange. The slots are again preferably T-shaped and are sized to receive and couple with cooperating hooking members extending forwardly from the second like form.

Advantageously, forms in accordance with the present invention include hydroseeding screens formed integrally with the form, each one of the screens being formed within a unique one of the regions bounded by the supporting ribs.

In another aspect of the present invention, there is provided a structure for stabilizing an earthen embankment, the structure comprising a support form as described above in combination with a geogrid anchored to the floor section of the form by at least one and preferably a pair of geogrid anchoring rods. In cases where a pair of anchoring rods are used, one of the rods extends through the anchoring members. The other rod abuts against the anchoring members. An end portion of the geogrid is advantageously wrapped back and forth around the anchor rods so as to tighten thereon when the geogrid is pulled in longitudinal tension away from said floor section.

Using a pair of anchor rods in the foregoing manner enables a geogrid to be anchored quickly efficiently without imposing undesirable stresses on the geogrid when the geogrid is tensioned. Another point to note is that the strength of the anchoring connection (viz. the "pull-out" factor) will proportionately increase as the tension applied to the geogrid is increased. Further, the anchoring connection is not dependent on placing backfill on the connection to provide resistance and is hence necessarily independent of the quality of such backfill. The frictional resistance which backfill may have to offer is immaterial to the connection strength.

The invention will now be described in more detail with reference to following drawings.

DETAILED DESCRIPTION OF PREFERRED EMBODIMENTS

Referring now to FIGS. 1-6, there is shown a composite form generally designated 15 for stabilizing an earthen embankment (not shown). Form 15 comprises a vertically extending rectangular face section generally designated 20 integrally formed with a horizontally extending floor section generally designated 40 extending horizontally rearwardly therefrom.

Figure 2:
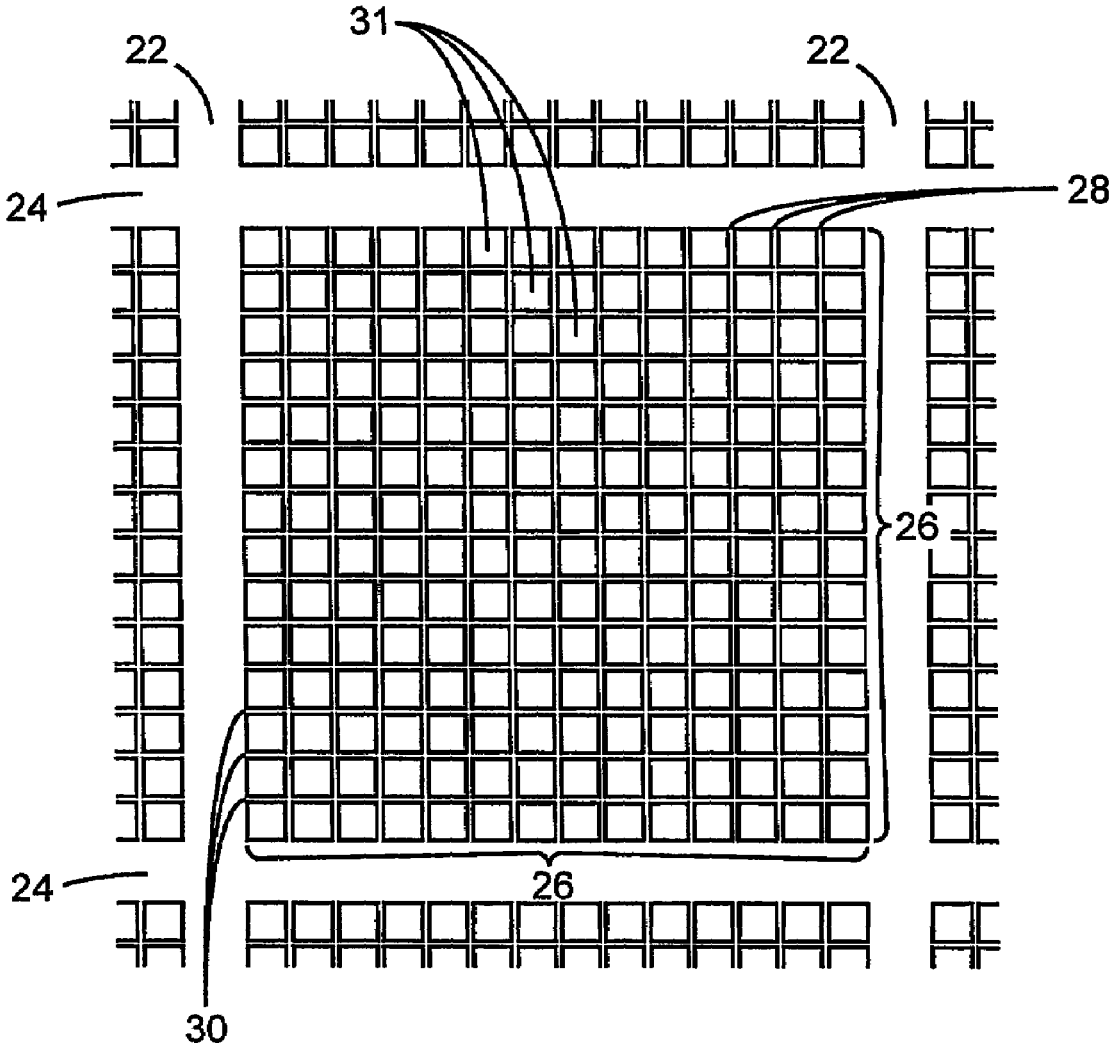
FIG. 2 is an elevation view illustrating in more detail one of the hydroscreening screens integrally formed between ribs in the face section of the form shown in FIG. 1 and, in partially cut-away view, similar hydroseeding screens which are adjacent thereto.

Face section 20 includes a grid formed by a plurality of vertically extending supporting ribs 22 and a plurality of horizontally extending supporting ribs 24 which intersect ribs 22. A fine mesh screen 26 (herein referred to as a hydroseeding screen) is integrally formed within each intervening region between ribs 22, 24. As best seen in FIG. 2, each hydroseeding screen 26 comprises a plurality of vertically extending ribs 28 and a plurality of horizontally extending ribs 30 which intersect ribs 28 in a manner which defines a plurality of square apertures 31 extending through face section 20.

The purpose of ribs 22, 24 is to provide structural strength to face section 20. The purpose of hydroseeding screens 26 is to facilitate hydroseeding. More particularly, screens 26 provide a foundation integral with form 15 against which a desired plant growth medium (not shown) can be hydrosprayed from the rear of the form. When seeds contained in the medium subsequently sprout, apertures 31 provide paths through which the resulting plants can grow. While such hydrospraying may be performed at a construction site, screens 26 advantageously enable forms to be hydrosprayed at a remote site where the process may be controlled and managed more efficiently. The hydrosprayed forms are then transported from the remote site for installation at a construction site.

Figure 3:
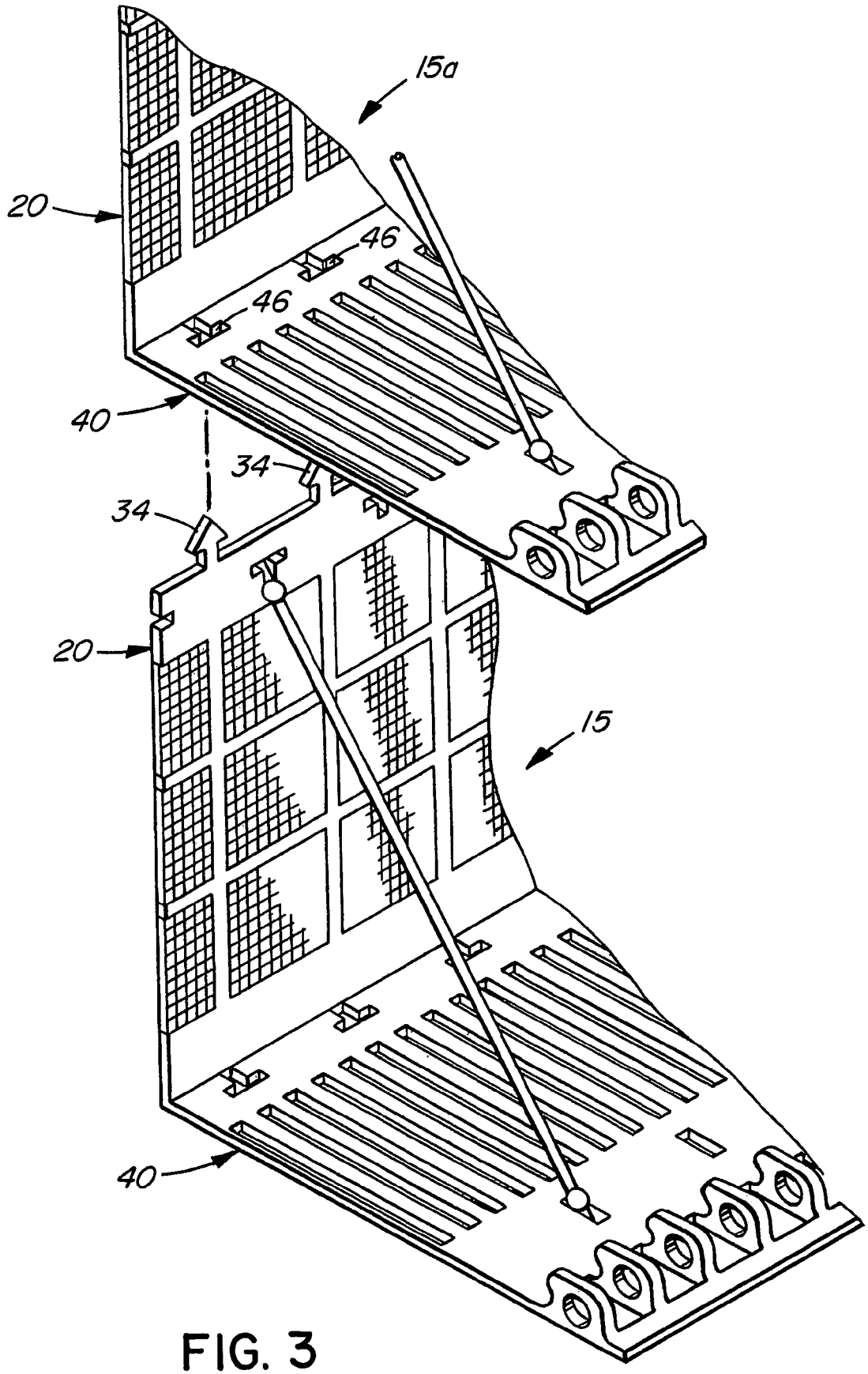
FIGS. 3 and 4 are partially cut-away isometric views showing the connection of two forms like the form shown in FIG. 1.
Figure 4:
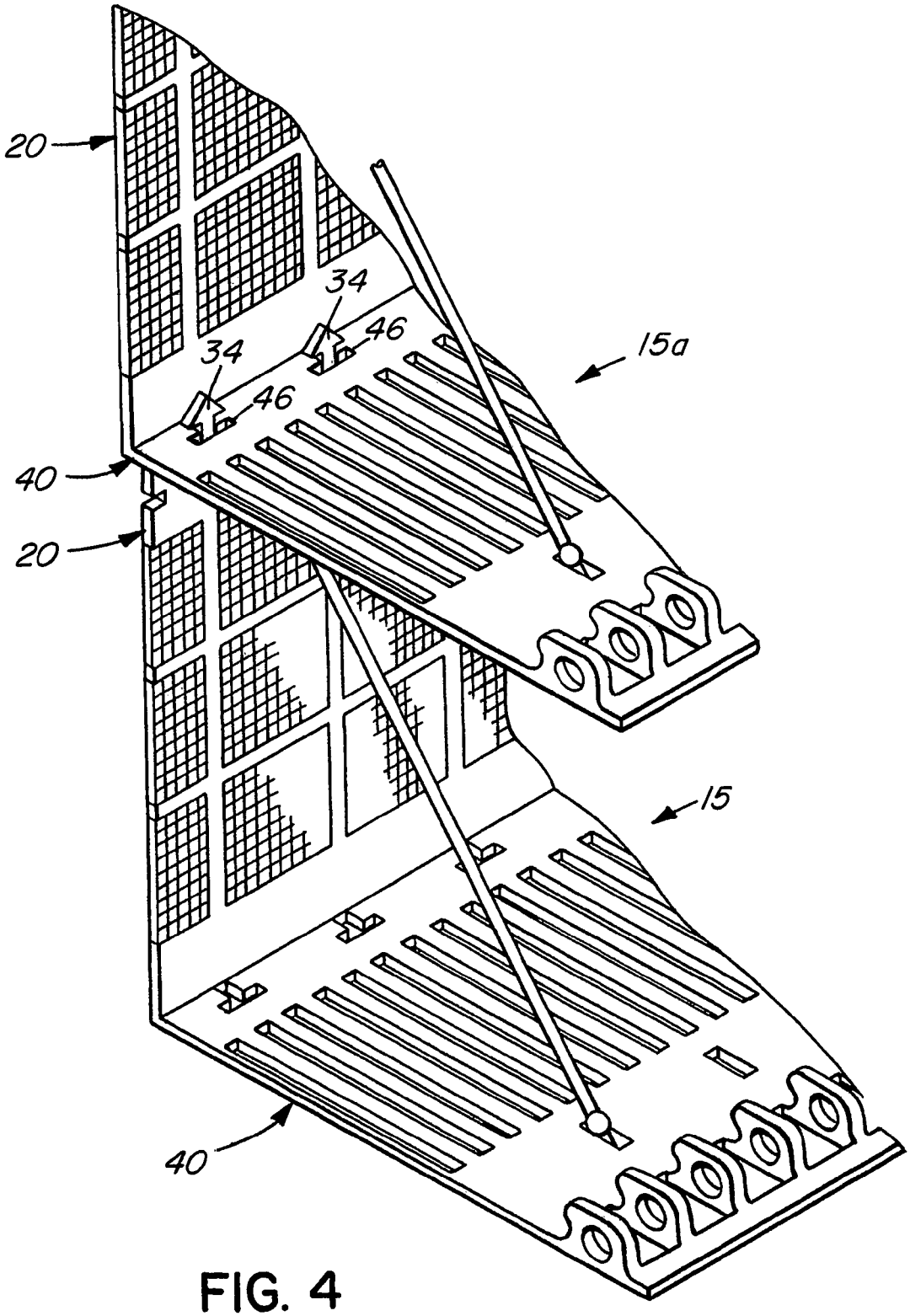
Figure 5:
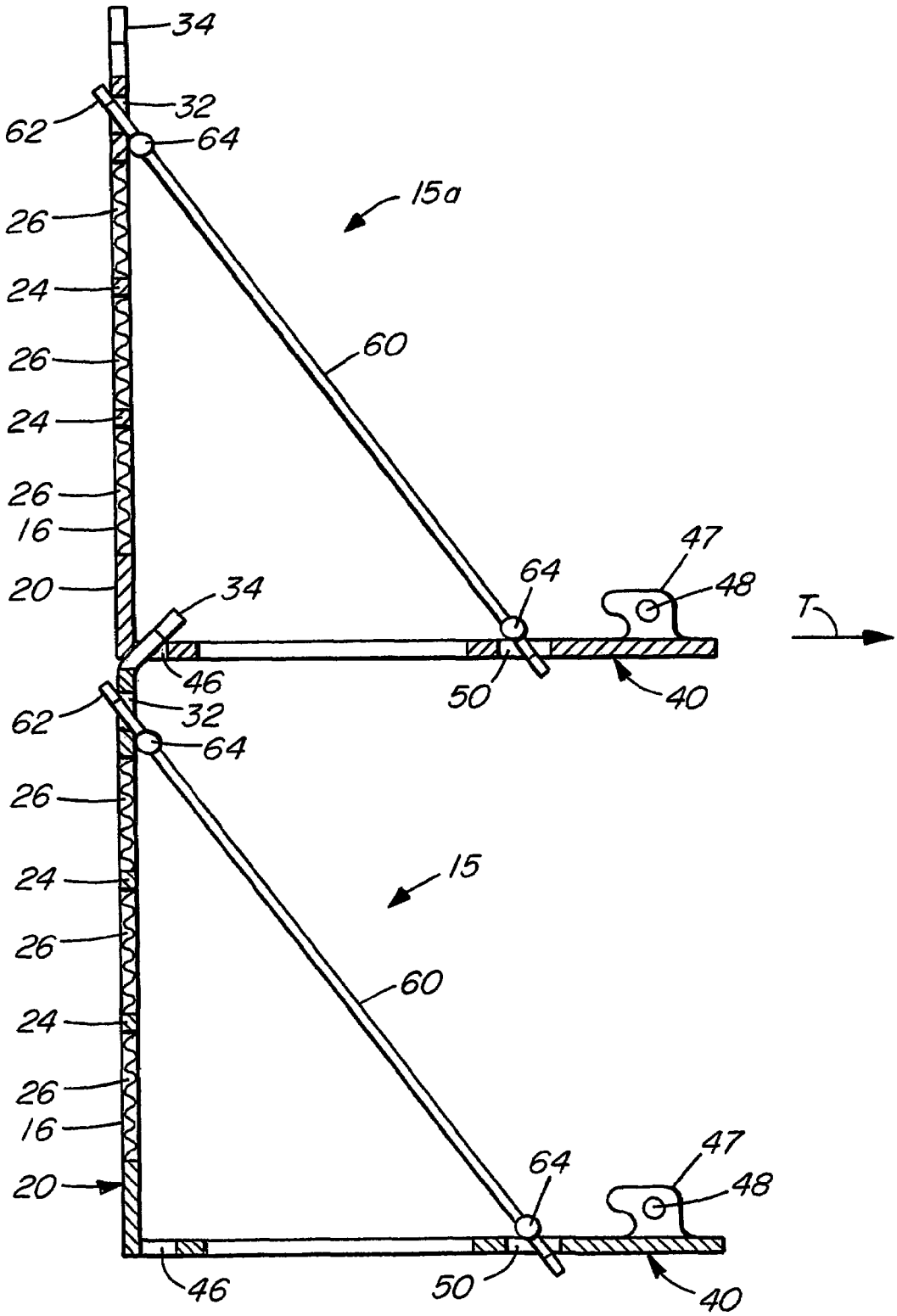
FIG. 5 is a section elevation view showing the connection of two forms like the form shown in FIG. 1.
Figure 6:
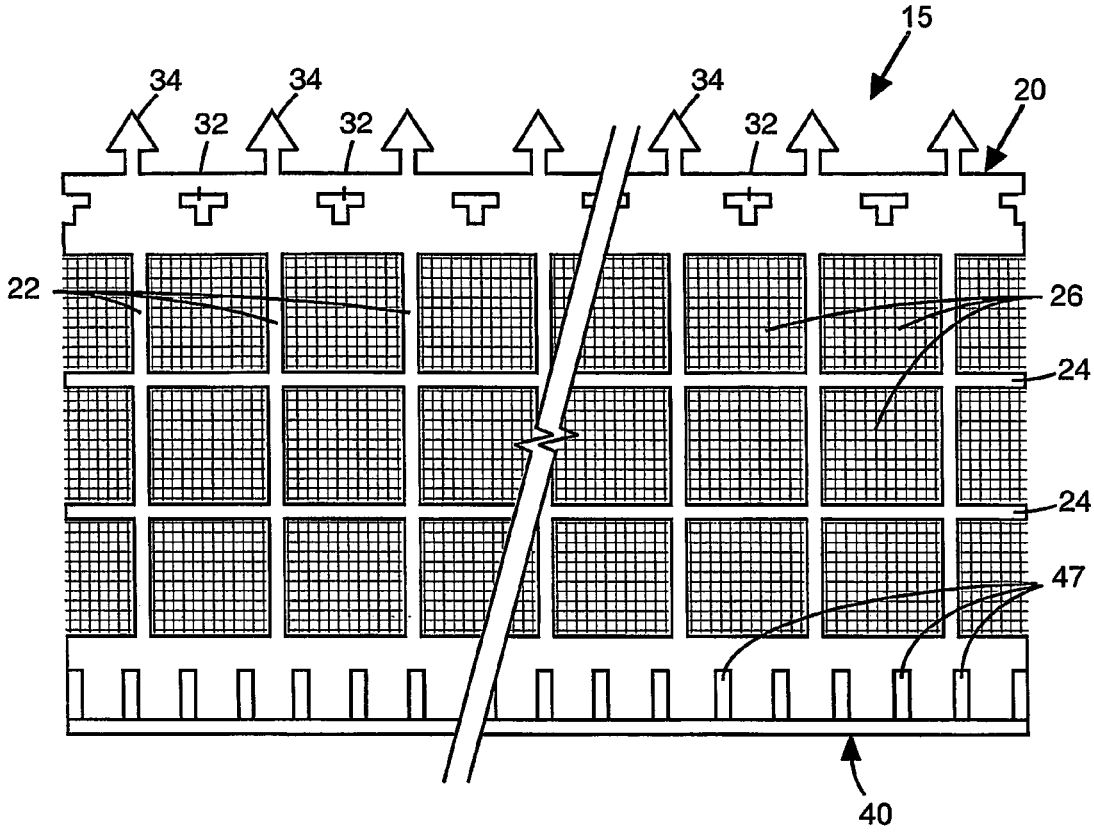
FIG. 6 is a partially cut-away rear elevation of the form shown in FIG. 1.

Horizontally spaced T-shaped slots 32 extend through face section 20 for engaging diagonal reinforcing struts 60. A plurality of horizontally spaced hooking members 34 extend upwardly from face section 20 for engaging another form like form 15 (e.g. form 15*a* as shown in FIGS. 3-5) that may be positioned directly above form 15.

Floor section 40 includes openings in the form of a plurality of horizontally spaced elongated drainage slots 42 extending between ribs 44. Further, floor section 40 includes a plurality of horizontally spaced T-shaped slots 46. The purpose of slots 42 is to enable moisture to pass through floor section 40 when required. The purpose of slots 46 is to enable form 15 to be coupled with another like form when it is considered desirable to do so.

Floor section 40 also includes a plurality of horizontally spaced, integrally formed bosses or anchoring members 47 for anchoring a soft geogrid (not shown in FIGS. 1-6 but which is described below in more detail in relation to FIG. 9). Each anchoring member 47 includes a hole 48 axially aligned with corresponding holes 48 in the other anchoring members 47 for longitudinally receiving an anchoring rod (again not shown in FIGS. 1-6, but see FIG. 9 and the related description below).

Figure 1:
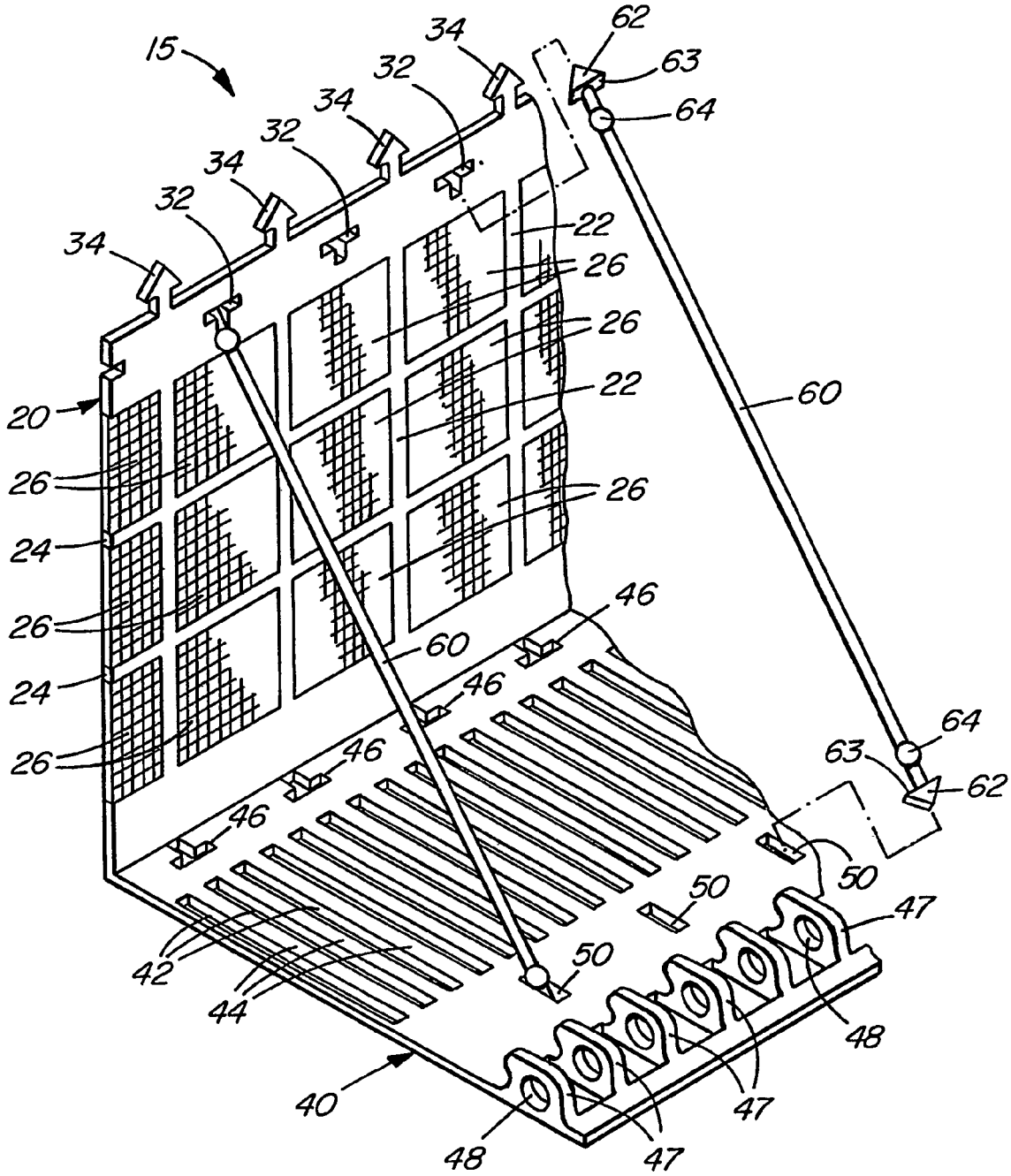
FIG. 1 is a partially cut-away isometric view from the rear of a composite form in accordance with the present invention.

Horizontally spaced rectangular slots 50 extend through floor section 40 for engaging reinforcing struts 60 in cooperation with the engagement provided by slots 32 in face section 20. For each slot 32 in face section 20, there is an aligned slot 50 in floor section 40. As best seen in FIG. 1, each reinforcing strut 60 includes at each of its ends an arrowhead-shaped hooking member 62 which can be fitted either through one of slots 32 or through one of slots 50. When fitted through a slot 32, base 63 is engaged by the front surface of face section 20. When fitted through a slot 50, base 63 is engaged by the bottom surface of floor section 40. Preferably, struts 60 includes ball or otherwise suitably shaped stops 64 set back on the shaft of the struts to limit the distance that the struts can be pushed through slots 32, 50.

It should be noted that the number of aligned pairs of slots 32, 50 may exceed the number of struts 60 that are actually used in any given situation. Further, it should be noted that the inclusion of stops 64 is considered desirable to assist workmen during the process of installing a strut 60, but is not considered to be essential.

Apart from reinforcing struts 60 which are manufactured separately, a significant feature of form 15 is that it can be manufactured from polyurethane as an integral unit using well known pultrusion, die cutting and related processes. Alternately, it can be manufactured by known molding processes using polyolefins.

The coupling of one form 15 to another like form 15*a* is indicated in FIGS. 3-5. In FIG. 3, form 15 has already been installed and backfill (not shown) will have been added rearwardly from face section 20 and on top of floor section 40. Form 15*a* is being lowered into position with it slots 46 aligned with hooking members 34 of form 15. In FIG. 4, initial coupling has been achieved with hooking members 34 of form 15 extending through slots 46 of form 15*a*. FIG. 5 also shows coupling between forms 15 and 15*a* but with form 15*a* now pulled rearwardly in the direction of arrow "T" such that front 16 of form 15*a* vertically aligns with front 16 of form 15. In this position, hooking members 34 of form 15 are bent rearwardly.

In a exemplary case, the height of face section 20 and the rearward extension of floor section 40 are each about 18 inches. The vertical and horizontal spacing between ribs 22, 24 is about 4 inches, and the horizontal and vertical spacing between ribs 28, 30 of screens 26 is about ¼ to ⅜ inches. The hole diameter of holes 48 is preferably about 1 inch or larger.

With reference to screens 26, it will be understood by those skilled in the art that a screen suitable for hydroseeding need not have square apertures 31 as illustrated. Other geometries such as round or hexagonal geometries which have a relatively fine hole spacing also will suffice. However, regardless of the geometry which is adopted, a desirable screen feature is that workers should be able to easily produce voids in selected screens with relative ease.

Figure 7:
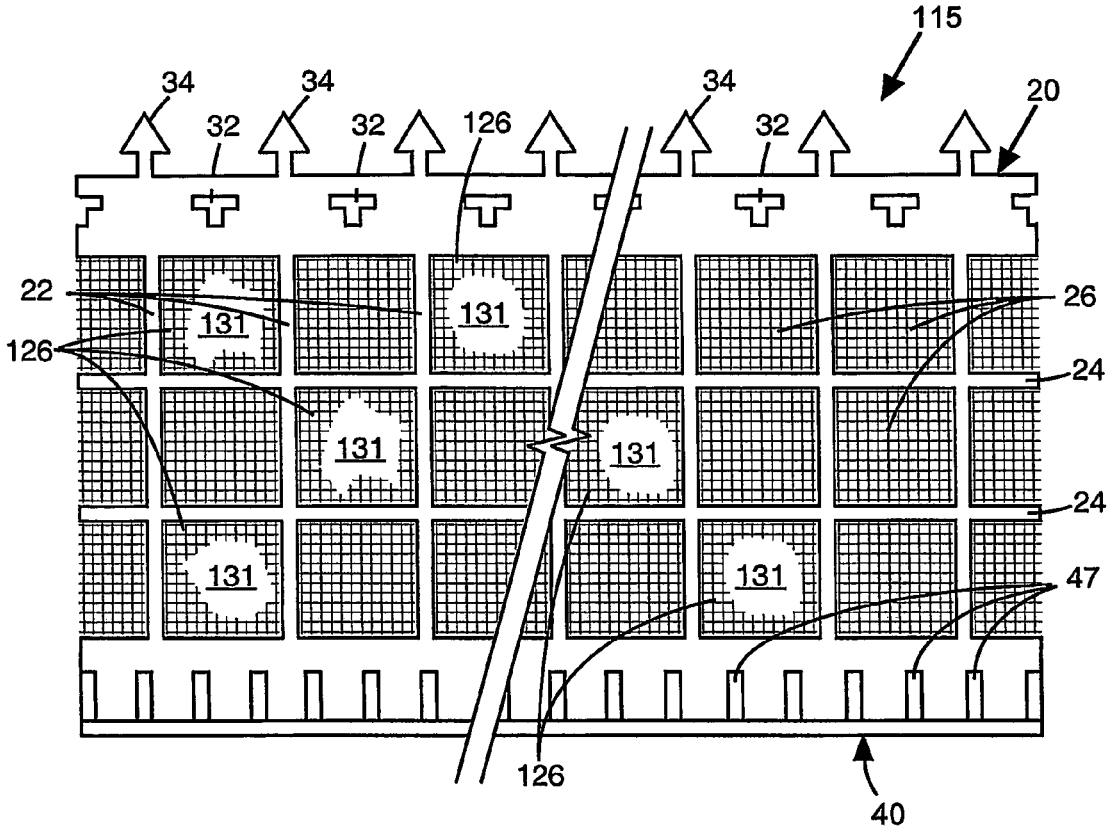
FIG. 7 is a rear elevation view as in FIG. 6, but with some fine mesh screen areas broken away to produce voids.

In FIG. 7, a form 115 originally like form 15 has been modified by breaking away a part of selected ones of the screens 26 in the original form to produce screens 126 with voids 131. A number of the original screens 26 remain intact.

Voids 131 can be irregular in size. Their purpose is to facilitate major plantings such as ivy. Typically, the step of producing such voids may be taken in a rudimentary but efficient manner on site after the form has been initially set in position (for example, by a hammer blow or with a cordless drill.).

Figure 8:
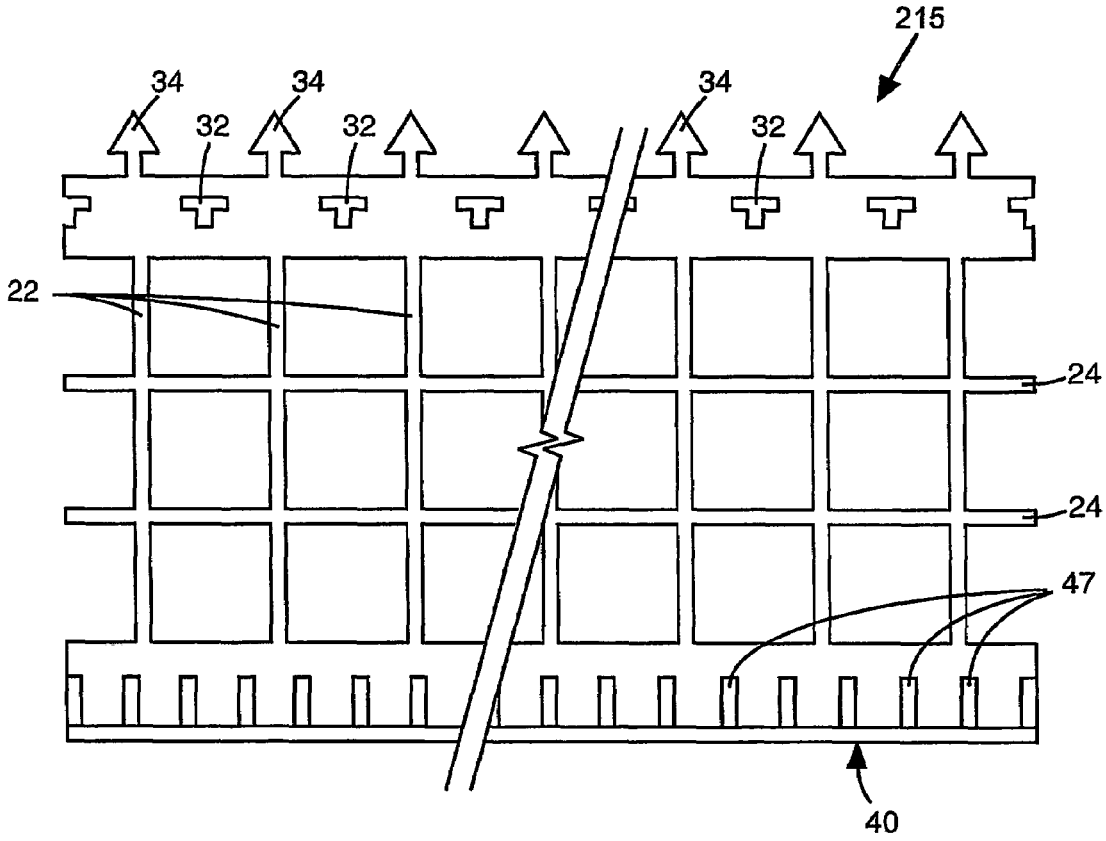
FIG. 8 is a partially cut-away rear elevation view of a composite form in accordance with the present invention, but which does not include any fine mesh screen areas as in the case of the form shown in FIG. 1.

In some cases, it may be decided not to include hydroseeding screens. For example, such a decision may occur if the aggregate size in the earthen embankment to be stabilized is relatively large. Composite form 215 illustrated in FIG. 8 does not include any screens to facilitate hydroseeding. However, apart from the absence of such screens, the structure of form 215 may be considered substantially the same as that of form 15. Note that form 215 is not a case where screens 26 have been broken away. It is a case where such screens were excluded from the manufacturing process.

Figure 9:
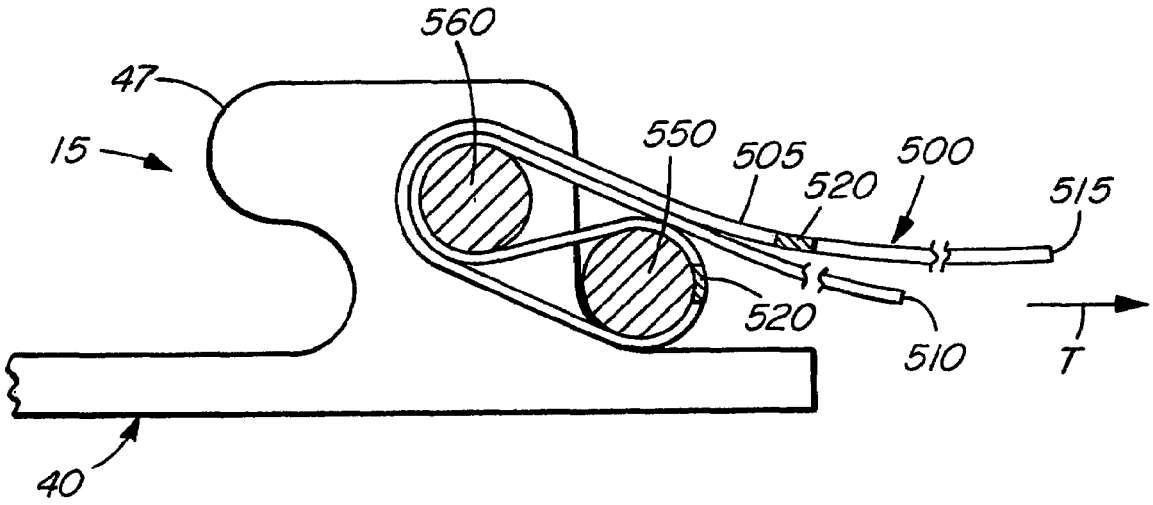
FIG. 9 is a side elevation view showing the connection of a geogrid to the form shown in FIG. 1.

Referring now to FIG. 9, anchoring members 47 enable a conventional geogrid generally designated 500 to be anchored to form 15 in a very secure manner. Geogrid 500 comprises a plurality of spaced elongated tension webs 505 extending from a forward end 510 of the geogrid to a rearward end 515, and a plurality of spaced webs 520 horizontally intersecting tension members 505. The anchoring technique employs two elongated anchoring rods 550, 560. Each rod 550, 560 extends transverse to the form. Rod 550 is positioned rearward of rod 560 immediately rearward of anchoring members 47. Rod 560 extends parallel to rod 550 and longitudinally through holes 48 in anchoring members 47. Geogrid 500 extends from its forward end 510:

first forwardly above rods 550 and 560 to a position above rod 560;

then wrapping around rod 560 to a position below rod 560;

then rearwardly to a position above rod 550;

then wrapping around rod 550 to a position below rod 550;

then forwardly to a position below rod 560;

then wrapping around rod 560 to a position above rod 560;

then rearwardly above rod 550 and distantly away from form 15 to its rearward end 515.

When longitudinal tension is applied to geogrid 500 in the direction of arrow T, rod 550 is pulled by the geogrid forwardly against the rearward side of anchoring member s47.

After the geogrid is installed and tensioned, backfill (not shown) is then added in the usual manner.

It will be understood by those skilled in the art that a geogrid could be anchored to form 15 using a conventional bodkin connection. However, when the geogrid is longitudinally tensioned, the transverse webs 520 of the geogrid then may be pulled against anchoring members 47. With sufficient tension, the members may tear through the webs. The anchoring technique shown in FIG. 9 avoids this disadvantage because geogrid 500 does not draw against the anchoring members. Rather, it draws against anchoring rods 550, 560 which do not stressfully engage the transverse webs of the geogrid.

The embodiments described above are all ones where it is contemplated that the earthen embankment to be stabilized is a substantially vertical embankment. Face section 20 of form 15 accordingly thus extends upwardly at a 90 degree angle with respect to floor section 40. For the purpose of stabilizing embankments having a slope of less than 90 degrees, it will be understood by those skilled in the art that the angle between the face and floor sections of form 15 may be correspondingly reduced.

Figure 10:
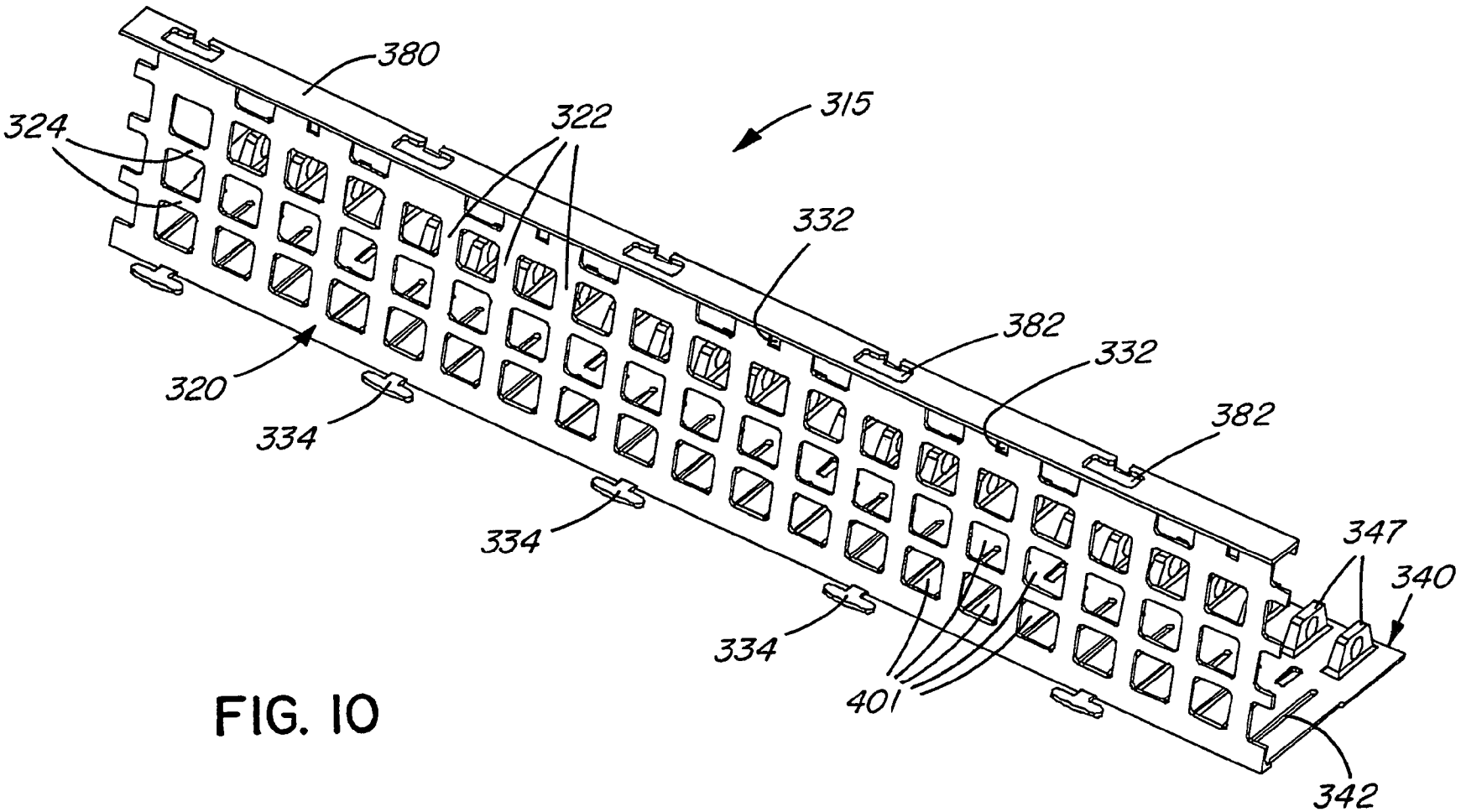
FIG. 10 is a perspective view from the front of another composite form in accordance with the present invention.
Figure 11:
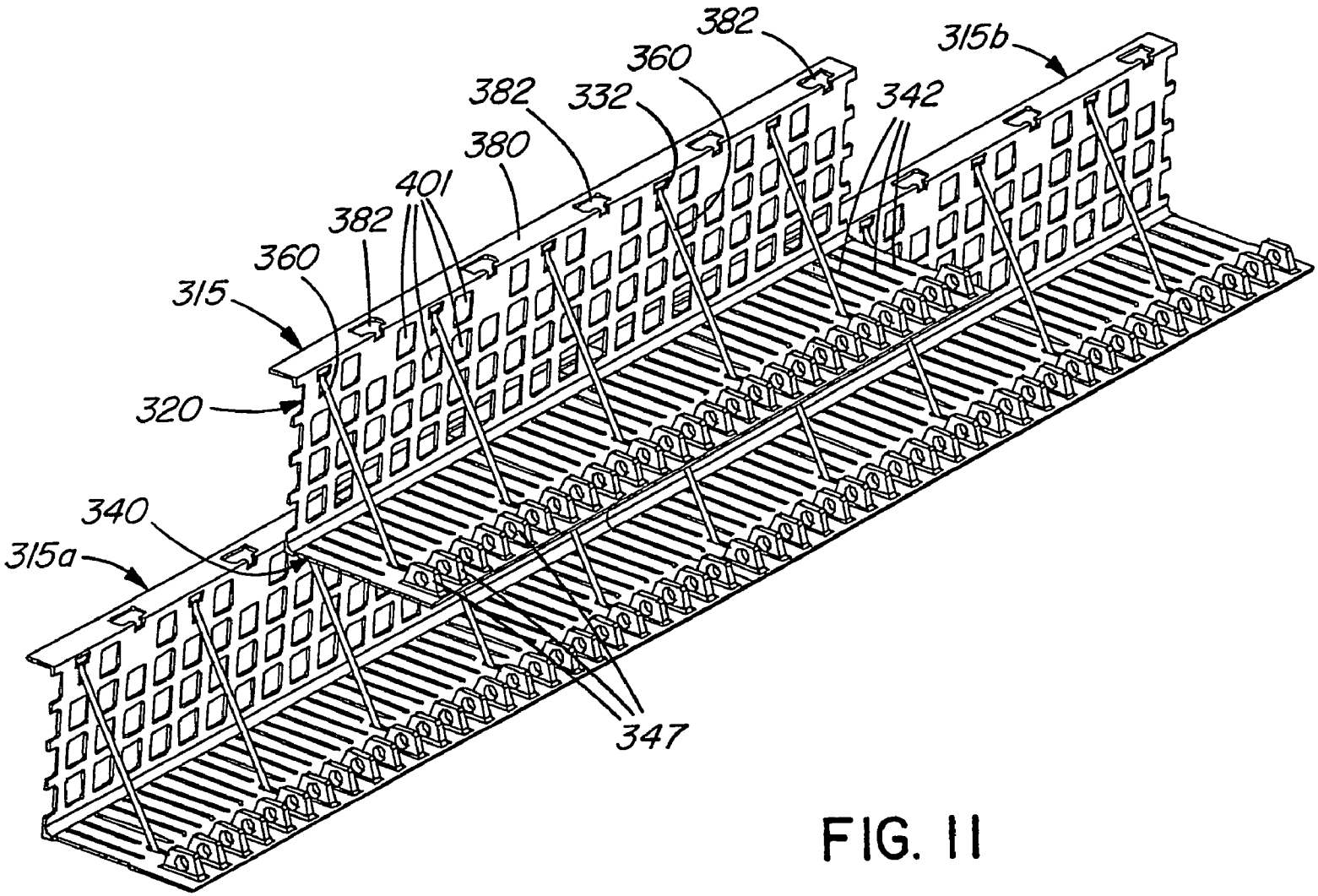
FIG. 11 is a perspective view from the rear showing the connection of the form shown in FIG. 10 with two like forms.
Figure 12:
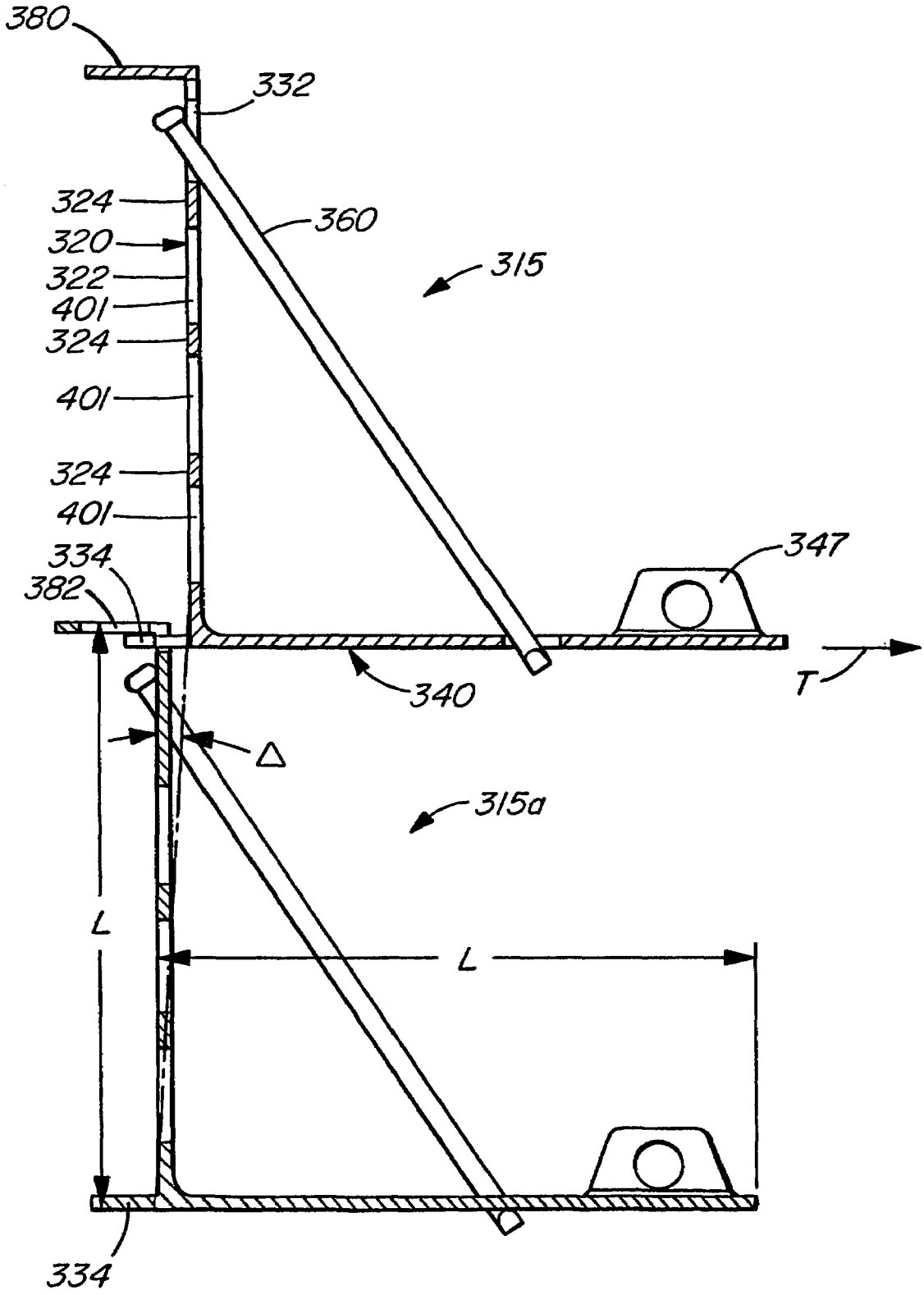
FIG. 12 is a section elevation view showing the connection of two forms like the form shown in FIG. 10.

Referring now to FIGS. 10-12, there is shown another composite form generally designated 315 for stabilizing an earthen embankment (not shown). Form 315 embodies many features which are generally the same as or similar to those of form 15.

More particularly, form 315 comprises a vertically extending rectangular face section generally designated 320 integrally formed with a horizontally extending floor section generally designated 340 extending horizontally rearwardly therefrom. Face section 320 includes a grid formed by a plurality of vertically extending supporting ribs 322 and a plurality of horizontally extending supporting ribs 324 which intersect ribs 322. As depicted in FIGS. 10-11, there are rows and columns of generally rectangular voids or openings 401 in the intervening regions between ribs 322, 324. However, it is to be understood that hydroseeding screens like hydroseeding screens 26 of form 15 may be integrally formed within each of such openings 401 at the time form 315 is manufactured.

Horizontally spaced T-shaped slots 332 extend through face section 320 for engaging diagonal reinforcing struts 260. An integrally formed flange 380 extends forwardly from the top end of face section 320 and includes a plurality of horizontally spaced T-shaped slots 382 which partially extend into face section 320.

Floor section 340 includes openings in the form of a plurality of spaced elongated drainage slots 342, the purpose of which slots is to enable moisture to pass through floor section 340 when required. A plurality of horizontally spaced T-shaped hooking members 334 extend forwardly from the forward end of floor section 340—this end being integrally coincident with the bottom of face section 320. Hooking members 334 are sized to engage and couple with slots like slots 382 mentioned above thereby permitting form 315 to be engaged from above or below with other like forms.

As shown in FIG. 11, form 315 is coupled with two like forms 315*a*, 315*b* which horizontally abut one another. The coupling is staggered thereby allowing form 215 to hold forms 315*a*, 315*b* in abutment. In a completed installation which may comprise several tiers of abutting forms, each tier comprising several forms, the staggered coupling of forms between adjacent tiers advantageously provides enhanced overall stability because undesirable movement of any one form is directly or indirectly restrained by the other forms.

A primary difference between form 315 and form 15 is the manner of coupling between like forms. In the case of form 15, there can be some stress of hooking members 34 when like forms are coupled, tension T is applied, and hooking members 34 are bent rearwardly as shown in FIG. 5. In the case of form 315, there is no comparable stress because hooking members 334 are not subject to such bending. When tension T is applied as shown in FIG. 12, hooking members 334 will draw against the face of the form to which they are hooked.

It will be noted (best seen in FIG. 12) that when like forms are coupled from above or below then there is an offset from true vertical front between one tier and the next. In an exemplary case where the length "L" of the floor sections and face sections is about 18 inches, then the angular offset Δ from true vertical may be about 3 degrees. For practical purposes, this normally will be considered insignificant.

Otherwise, it is to noted that form 315 includes horizontally spaced bosses or anchoring members 347 similar to anchoring members 47 of form 15. A geogrid like geogrid 500 can be anchored to form 315 utilizing anchoring rods like anchoring rods 550, 560 in essentially the same manner as geogrid 500 is anchored to form 15.

A variety of modifications, changes and variations to the invention are possible within the spirit and scope of the following claims, and will undoubtedly occur to those skilled in the art. The invention should not be considered as restricted to the specific embodiments that have been described and illustrated with reference to the drawings. In the claims, meansplus-function clauses are intended to cover the structures described herein as performing the recited function and not only structural equivalents but also equivalent structures.

The invention claimed is:

1. A composite form for stabilizing an earthen embankment, said form comprising:

(a) a floor section extending longitudinally rearwardly from a forward end of the floor section to a rearward end of the floor section, said floor section including;

(i) a plurality of horizontally spaced anchoring members formed integrally with said floor section and located proximate to the rearward end of said floor section; said anchoring members for holdingly engaging at least one geogrid anchoring rod; and, (ii) a plurality of drainage openings extending through said floor section for permitting the drainage of moisture through said floor section;

(b) a face section formed integrally with and extending longitudinally at an angle upwardly from said forward end of said floor section to a top end of said face section, said face section comprising a first plurality of supporting ribs and a second plurality of supporting ribs, said second plurality of supporting ribs intersecting said first plurality of supporting ribs to define a plurality of regions bounded by said ribs;

(c) first and second coupling means formed integrally with said form:

(i) said first coupling means for fully coupling said form with a like second coupling means of a first complimentary shaped like form extending above said form; and, (ii) said second coupling means for fully coupling said form with a like first coupling means of a complimentary shaped second like form extending below said form.

2. A form as defined in claim 1, wherein:

(a) said first coupling means comprises a plurality of horizontally spaced hooking members extending upwardly from said face section; and, (b) said second coupling means comprises a plurality of horizontally spaced slots extending through said floor section, said slots being sized to receive and couple with cooperating hooking members extending upwardly from said second like form.

3. A form as defined in claim 1, further comprising a flange extending forwardly from said top end of said face section, and wherein:

(a) said first coupling means comprises a plurality of horizontally spaced hooking members extending forwardly from said forward end of said floor section; and, (b) said second coupling means comprises a plurality of horizontally spaced slots extending through said flange, said slots being sized to receive and couple with cooperating hooking members extending forwardly from said second like form.

4. A form as defined in claim 3, wherein said slots are T-shaped slots.

5. A form as defined in claim 1, 3 or 4, further including a plurality of hydroseeding screens formed integrally with said form, each one of said screens being formed within a unique one of said regions bounded by said supporting ribs.

6. A form as defined in claim 1, 3 or 4, wherein each anchoring member comprises a boss, each boss including a hole extending through the boss, the said holes in all said bosses being axially aligned.

7. A form as defined in claim 1, 3 or 4, wherein said drainage openings comprise a plurality of elongated drainage slots.

8. A structure for stabilizing an earthen embankment, said structure comprising a composite form having:

(a) a floor section extending longitudinally rearwardly from a forward end of the floor section to a rearward end of the floor section, said floor section including:

(i) a plurality of horizontally spaced anchoring members formed integrally with said floor section and located proximate to the rearward end of said floor section; said anchoring members holdingly engaging at least one geogrid anchoring rod; and, (ii) a plurality of drainage openings extending through said floor section for permitting the drainage of moisture through said floor section;

(b) a face section formed integrally with and extending longitudinally at an angle upwardly from said forward end of said floor section to a top end of said face section, said face section comprising a first plurality of supporting ribs and a second plurality of supporting ribs, said second plurality of supporting ribs intersecting said first plurality of supporting ribs to define a plurality of regions bounded by said ribs;

(c) first and second coupling means formed integrally with said form:

(i) said first coupling means for fully coupling said form with a like second coupling means of a first complimentary shaped like form extending above said form; and, (ii) said second coupling means for fully coupling said form with a like first coupling means of a complimentary shaped second like form extending below said form, said structure further comprising a geogrid anchored to said floor section by said at least one geogrid anchoring rod.

9. A structure as defined in claim 8, said anchoring members holdingly engaging a pair of said geogrid anchoring rods, one of said anchoring rods extending through said anchoring members, the other of said anchoring rods abutting against said anchoring members, an end portion of said geogrid being wrapped back and forth around said anchor rods so as to tighten thereon when said geogrid is pulled in longitudinal tension away from said floor section.

10. A structure as defined in claim 8 or 9, wherein:

(a) said first coupling means comprises a plurality of horizontally spaced hooking members extending upwardly from said face section; and, (b) said second coupling means comprises a plurality of horizontally spaced slots extending through said floor section, said slots being sized to receive and couple with cooperating hooking members extending upwardly from said second like form.

11. A structure as defined in claim 8 or 9, further comprising a flange extending forwardly from said top end of said face section, and wherein:

(a) said first coupling means comprises a plurality of horizontally spaced hooking members extending forwardly from said forward end of said floor section; and, (b) said second coupling means comprises a plurality of horizontally spaced slots extending through said flange, said slots being sized to receive and couple with cooperating hooking members extending forwardly from said second like form.

12. A structure as defined in claim 8 or 9, further including a plurality of hydroseeding screens formed integrally with said form, each one of said screens being formed within a unique one of said regions bounded by said supporting ribs.

13. A form as defined in claim 1, 3 or 4, further including a plurality of hydroseeding screens formed integrally with said form, each one of said screens being formed within a unique one of said regions bounded by said supporting ribs and having screen mesh size openings of not more than ⅜ inches by ⅜ inches.

14. A structure as defined in claim 8 or 9, further including a plurality of hydroseeding screens formed integrally with said form, each one of said screens being formed within a unique one of said regions bounded by said supporting ribs and having screen mesh size openings of about ¼ inch by ¼ inch.

15. A method of stabilizing an earthen embankment at an embankment construction site, said method comprising:

(a) providing an earthen embankment stabilizing form, said form comprising:

(i) a floor section extending longitudinally rearwardly from a forward end of the floor section to a rearward end of the floor section;

(ii) a face section formed integrally with and extending longitudinally at an angle upwardly from said forward end of said floor section to a top end of said face section, said face section comprising a first plurality of supporting ribs and a second plurality of supporting ribs, said second plurality of supporting ribs intersecting said first plurality of supporting ribs to define a plurality of regions bounded by said ribs;

(iii) a plurality of hydroseeding screens formed integrally with said form, each one of said screens being formed within a unique one of said regions bounded by said supporting ribs;

(b) positioning said form at a predetermined location at said construction site;

(c) when said form is so positioned, then anchoring a geogrid to the floor section of the form; and, (d) hydrospraying said face section from the rear of said form with a seeded plant growth medium.

16. A method as defined in claim 15, wherein said face section is hydroseeded at a site remote from said construction site, and wherein said form is then transported to said construction site.

17. A method as defined in claim 15 or 16, wherein said screens have mesh size openings of not more than ⅜ inches by ⅜ inches.

18. A method as defined in claim 15 or 16, wherein said screens have mesh size openings of about ¼ inch×¼ inch.

* * * * *